United States Patent [19]

Suzuki et al.

[11] Patent Number: 4,521,101

[45] Date of Patent: Jun. 4, 1985

[54] LIQUID DEVELOPING APPARATUS FOR ELECTROPHOTOGRAPHY

[75] Inventors: Shigeyoshi Suzuki; Jun Yamada; Takao Senga; Sadao Kuriu, all of Nagaokakyo; Masahiro Yamasaki, Otsu; Iwao Hirose, Hikone; Tokubee Maegawa, Shiga, all of Japan

[73] Assignees: Mitsubishi Paper Mills, Ltd., Tokyo; Dainippon Screen Mfg. Co., Ltd., Kyoto, both of Japan

[21] Appl. No.: 503,602

[22] Filed: Jun. 13, 1983

[30] Foreign Application Priority Data

| | | | |
|---|---|---|---|
| Jun. 18, 1982 | [JP] | Japan | 57-91211[U] |
| Jun. 18, 1982 | [JP] | Japan | 57-91212[U] |
| Jun. 18, 1982 | [JP] | Japan | 57-91213[U] |
| Jun. 18, 1982 | [JP] | Japan | 57-91214[U] |

[51] Int. Cl.[3] ..... G03G 15/10

[52] U.S. Cl. ..... 355/10; 355/27; 118/647; 118/662

[58] Field of Search ..... 355/10, 27; 118/644, 118/647, 648, 660, 662, 429; 430/103, 117

[56] References Cited

U.S. PATENT DOCUMENTS

| | | | |
|---|---|---|---|
| Re. 31,177 | 3/1983 | Kogiso et al. | 355/10 X |
| 3,784,397 | 1/1974 | Sato et al. | 355/10 X |
| 3,791,345 | 2/1974 | McCutcheon | 118/662 |

*Primary Examiner*—A. T. Grimley
*Assistant Examiner*—J. Pendegrass
*Attorney, Agent, or Firm*—Cushman, Darby & Cushman

[57] ABSTRACT

A liquid developing apparatus for electrophotograph in which an electrostatic latent image surface of a photoconductive material is confronted with developing electrodes and at the same time is transferred in the liquid toner to be developed, the developing apparatus characterized by comprising a developing chamber defined by a bottom plate held substantially in a horizontal position or slanted with a downstream side in the photoconductive material transferring direction being kept at a lower level, developing electrodes facing the bottom plate at predetermined intervals and forming ceiling plates and side plates, the developing chamber being divided into a front section and a rear section with respect to the photoconductive material transferring direction, an interval between the developing electrode in the front section of the developing chamber and the electrostatic latent image surface being smaller than that between the developing electrode in the rear section of the developing chamber and the electrostatic latent image surface, both end faces on the upstream and downstream sides being opened, and at least one supply passage for the liquid toner being provided at the front section of the developing chamber, between the front and rear sections and/or at a portion of the rear section near to the front section.

10 Claims, 8 Drawing Figures

LIQUID DEVELOPING APPARATUS FOR ELECTROPHOTOGRAPHY

FIELD OF THE INVENTION

The present invention relates to a liquid developing, apparatus for developing an electrophotographic photoconductive material on which an electrostatic image is formed, and more particulary, to a liquid developing apparatus for manufacturing a lithographic printing plate through an etching process.

DESCRIPTION OF THE PRIOR ART

A lithographic printing plate which is obtained by forming a toner image through an electrophotography on a printing plate having thereon a photoconductive organic compound layer, and after fixing, removing a non-image-forming portion other than the toner-image-forming portion with an alkaline aqueous etching solution in an etching process is well known from the following patent publications, Japanese Patent Publication Nos. 17162/'62, 6961/'63, 2426/'66, and 39405/'71, and Japanese Patent Laid-Open Nos. 19509/'75, 19803/'79, 134632/'79, 145538/'79, 105244/'80 and 146145/'81. Such a printing plate is manufactured as follows: Styrene-maleic acid anhydride copolymer, vinyl acetate-crotonic acid copolymer, vinyl acetate-maleic acid anhydride copolymer, phenol resin, acrylic or methacrylic resin with an acid value and the like which are soluble in an aqueous alkaline solution are used as binders. These binders are mixed with organic solvent and organic photoconductive compound and are applied onto an electric conductive metal plate such as an aluminum plate to be made a photoconductive plate i.e., a printing plate. Subsequently, according to the electrophotographic technique, a corona charge, an exposure, a toner development and a fixing are carried out on the photoconductive material or plate to thereby obtain a toner image. Furthermore, the toner image is used as a resist layer and the non-image portion other than the toner image is etching-removed by an aqueous alkaline etching solution so that a hydrophilic metal base plate is exposed at the non-image portion to thereby provide a lithographic printing plate in which the toner image portion has a hydrophobic property.

Toners to be used for forming an pictorial image may be so-called dry toners but in order to obtain a printed matter with a high resolving power, it is much more preferable to use wet toners according to the liquid developing method. Since the toners are used for the printing plate, the toners must have hydrophobic (anti-hydrophilic) property, ink-receiving property and such adhesivity to the printing plate that they may be durable against the printing, and in addition, the toners must have resist property upon etching with the aqueous alkaline etching solution.

Accordingly, in such a printing plate, a thin line of several tens of microns must be reproduced in a good condition enough to have the resist property. Also, as in a general photoconductive material, a photographic fog, a halo, a drag, an edge effect and the like must, of course, be actually prevented. Also, in view of the liquid developing apparatus aspect, it is necessary to prevent contaminating of rollers, developing electrodes, printing plates and the like with liquid toner and a cleaning operation must be facilitated.

SUMMARY OF THE INVENTION

An object of the present invention is to provide a liquid developing apparatus which meets the above-described demands, in particular, to provide a novel liquid developing apparatus which is suitable for developing a lithographic printing plate through a etching process.

According to the present invention, a liquid developing apparatus for electrophotography in which an electrostatic latent image surface of a photoconductive material is confronted with developing electrodes and at the same time is transferred in the liquid toner, is characterized by comprising a developing chamber defined by a bottom plate held substantially in a horizontal position or slanted with a downstream side in the photoconductive material transferring direction being kept at a lower level, developing electrodes facing the bottom plate at predetermined intervals and forming ceiling plates and side plates, wherein the developing chamber is divided into a front section and a rear section with respect to the photoconductive material transferring direction, an interval between the developing electrode in the front section of the developing chamber and the electrostatic latent image surface is smaller than that between the developing electrode in the rear section and the electrostatic latent image surface, both end faces on the upstream and downstream sides are opened, and at least one supply passage for the liquid toner is provided at the fornt section of the developing chamber, between the front and rear sections and/or at a portion of the rear section near to the front section.

In a preferred embodiment of the invention, the supply passage for the liquid toner is provided between the front section of the developing chamber and the rear section thereof or at the portion of the rear section of the developing chamber near the front section thereof and the developing chamber is slanted so that the liquid toner from the supply passage may flow to the front section of the developing chamber which is located at a relatively high level. Furthermore, in the preferred embodiment, a slant angle of the bottom plate of the developing chamber is defined below 30°, more preferably, 20°.

In another embodiment of the invention, the developing chamber is provided substantially horizontally and has the supply passage for the liquid toner between the front and rear sections of the developing chamber or at a portion of the rear section of the developing chamber near the front section thereof.

In still another preferred embodiment of the invention, the developing chamber is provided substantially horizontally and has the supply passages for the liquid toner between the front and rear sections of the developing chamber and at the front section thereof.

In still another preferred embodiment of an electrophotographic liquid developing apparatus of the invention, the developing chamber is provided to be slanted with the downstream side in the photoconductive material transferring direction being kept at a lower level and has the supply passages for the liquid toner at the front section of the developing chamber and between the front and rear sections thereof. In still another embodiment, the slant angle of the developing chamber is preferably defined in a range from about 15° to about 45°.

In still another embodiment of an electrophotographic liquid developing apparatus of the invention, a length of the front section of the developing chamber in the photoconductive material transferring direction is shorter than a length of the rear section thereof and an interval between the developing electrode in the front section of the developing chamber and the latent image surface of the photoconductive material is as long as 1/1.5 to one-fifth of an interval in the rear section of the developing chamber.

In still another embodiment of the electrophotographic liquid developing apparatus of the invention, a liquid toner supply bath is provided on the upstream side of the developing chamber, the liquid toner is supplied from the supply bath to the developing chamber by a gravitational force, and the liquid toner to flow through the developing chamber is collected to a liquid reservoir located downstream of the developing chamber and is recirculated from the liquid reservoir to the supply bath by a pump.

DETAILED DESCRIPTION OF THE PREFERRED EMBODIMENTS

Figure 1:
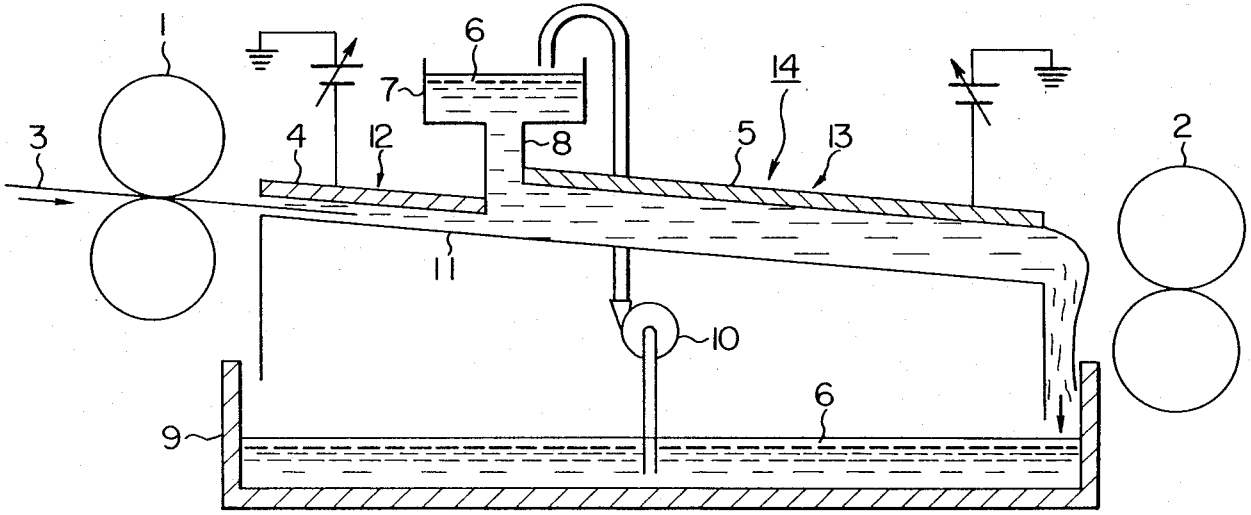
FIGS. 1, 3, 5 and 7 are schematic longitudinal sectional views showing various embodiments of electrophotographic liquid developing apparatuses according to the present invention.
Figure 2:
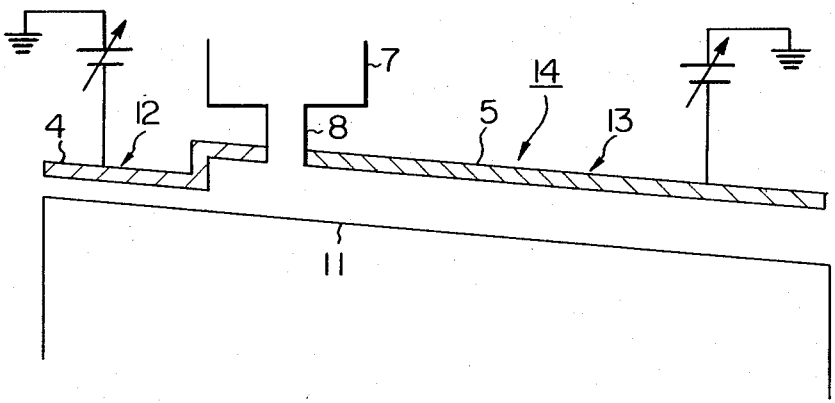
FIGS. 2, 4, 6 and 8 are schematic logitudinal sectional views showing only developing chambers which are different from those shown in FIGS. 1, 3, 5 and 7 in mounting position or shape of liquid toner supply passages, respectively.

The apparatus according to the present invention will now be described with reference to the accompanying drawings. FIG. 1 schematically shows a specific embodiment of an apparatus according to the present invention. FIG. 2 shows another embodiment in which the mounting position of the liquid toner supply passage is different from that shown in FIG. 1. The apparatus comprises a developing chamber 14, a liquid reservoir 9, a liquid toner supply bath or container 7 and other auxiliary means.

The developing chamber 14 is defined by a bottom plate 11 slanted with a downstream side of a photoconductive material 3 being kept at a lower level in the transferring direction as indicated by the arrow, developing electrodes 4 and 5 located to be confronted with the bottom plate 11 at predetermined intervals and to form ceiling plates, and side plates (not shown). As shown, end faces of the developing chamber on the higher and lower level sides are opened, the open face on the higher level side being provided with a pair of supply rollers 1 and the open face on the lower level side being provided with a pair of squeezee rollers 2. The photoconductive material 3 is transferred into the developing chamber 14 by the supply rollers 1 with its electrostatic latent image surface being directed upwardly, along with the bottom plate 11 and is discharged by the squeezee rollers 2 which serve to remove the liquid toner from the photoconductive material.

The developing chamber 14 is divided into a front section 12 and a rear section 13 in the transferring direction of the photoconductive material 3. The developing chamber 14 is so constructed that a distance between the developing electrode 4 in the front section 12 and the latent image surface of the photoconductive material 3 to be transferred is smaller than a distance between the electrode 5 in the rear section 13 and the latent image surface.

The liquid toner or solution 6 is supplied to the developing chamber 14 from the liquid toner supply bath 7 located above the developing chamber 14, through a supply passage 8 provided between the front section 12 and the rear section 13. The supply passage 8 may be provided in the rear section 13 near the front section 12 as shown in FIG. 2. The liquid toner 6 supplied from the supply passage 8 to the developing chamber 14 will flow on the higher and lower level sides. In the apparatus parameters such as the distances between the photoconductive material 3 (or the bottom plate 11) and the developing electrodes 4 and 5 and the slant angle of the bottom plate 11 are suitably selected so that a small amount of liquid toner 6 can flow from the higher level side. Of course, it is necessary that a space between the developing electrode 4 of the front section 12 of the developing chamber and the bottom plate 11 thereof be always filled with the liquid toner 6. Therefore, in order to reduce practice in actual design and operation, the liquid toner 6 is slightly flowing from the higher level side. In view of this, a slant angle of the bottom plate 11 is preferably defined at 30° or less, more preferably 20° or less.

Below the developing chamber 14, there is provided the liquid toner reservoir 9 for collecting therein the liquid toner 6 made to flow through the developing chamber 14 and recirculating it to the supply bath 7 by the action of the pump 10.

The function of the apparatus will be described. The photoconductive material 3 which has been transferred into the developing chamber 14 is brought into contact with the liquid toner 6 in the front section 12 and the rear section 13, thereby being developed. Since the flow rate of the liquid toner is small in the front section 12, the photoconductive material will be developed like a static development. In the case where the slant angle of the bottom plate 11 is increased, as a matter of course, the liquid toner 6 flows only on the downstream side of the developing electrode 5. In this case, although there is not caused a problem in resist property due to a sufficient amount of toner in a wide area image portion, the fine line image portion is developed with an insufficient amount of toner. As a result, even if there is no problem in a visible image, the resist property is seriously damaged disadvantageously. Also, there is a fear that the drag would tend to be caused and in addition, there is a disadvantage such that the supply rollers 1 would be contaminated. The image quality depends on the construction of the photoconductive material and the characteristics of the liquid toner (for example, the resist property), of course. According to the developing apparatus of the invention, these disadvantages may be overcome.

The liquid toner 6 in an amount to be required for developing the photoconductive material 3 is supplied through the liquid toner supply passage 8 and a part of the liquid toner will flow toward the developing electrode 4. The photoconductive material 3 transferred by the pair of supply rollers 1 are developed so that the overall image portion including fine line images is provided with substantially the same density by a small amount of the liquid toner 6 in the front section 12 of the developing chamber in which the distance between the developing electrode 4 and the latent image surface is kept smaller. It is preferable that the front section 12 of the developing chamber be shorter than the rear section 13 of the developing chamber in length. The distance between the developing electrode 4 and the latent image surface is kept shorter. As a result, the contact between the small amount of the liquid toner 6 and the photoconductive material 3 may be increased for a short period of time. Also, in the front section 12 of the developing chamber, the liquid toner 6 is made to flow at a low rate or kept similar to the static development so that the defects such as edge effect and drag may be eliminated and in addition, the contamination of the supply rollers 1 and the like may be avoided. Subsequently, in the rear section 13 of the developing chamber 13 provided with the developing electrode 5, the photoconductive material 3 is advanced in the same direction as the sufficient amount of liquid toner 6, whereupon the overall image including the fine line images are subjected to a sufficiently high density.

In the developing chamber rear section 13, it is preferable that a relative speed between the photoconductive material 3 and the liquid toner 6 be kept at approximately zero.

Although the length of the developing chamber front section 12 may be determined as desired, it is preferable that the front section 12 be shorter than the rear section 13 in length. Although it is preferable that the distance between the developing electrode 5 and the latent image surface be about 1.5 to 50 times longer than that between the developing electrode 4 and the latent image surface, there are no special limitations therein. These distances are usually such that the distance in the front section 12 of the developing chamber is 0.1 to 2 mm in case the distance in the rear section is 5 mm or less. Some problems, such as photographic fog, accompanied with such a design choice may be overcome by changing a bias voltage applicable to the developing electrodes 4 and 5.

In the apparatus, the distance between the electrodes and the latent image surface may be gradually increased from the developing chamber front section 12 through the liquid toner supply passage 8 to the developing chamber rear section 13.

In the embodiments shown in FIGS. 1 and 2, the liquid toner supply passage 8 is provided in the perpendicular direction. However, the arrangement of the supply passage is not limited thereto and the supply passage may be slanted as desired.

Other embodiments of the invention will now be described with reference to FIGS. 3 and 4. In these embodiments, the developing chamber is kept substantially in the horizontal position. The other structural components are provided substantially in the same manner as in the apparatus shown in FIGS. 1 and 2. Therefore, explanations for the like components has been omitted. A supply passage 8 for the liquid toner 6 is provided between a front section 12 and a rear section 13 of a developing chamber 14 in the apparatus shown in FIG. 3 and is provided in the rear section 13 near to the front section 12 in the apparatus shown in FIG. 4. A step formed at a boundary between the front section electrode 4 and the rear section electrode 5 is indicated by reference character 8'.

In the apparatus, since the developing chamber 14 is provided substantially in the horizontal position, there is a great possibility that the liquid toner 6 supplied through the supply passage 8 to the developing chamber 14 would flow through the right and left end faces. However, in the apparatus, by suitably selecting the parameters such as the distances between the developing electrodes 4 and 5 and the photoconductive material 3 (or the bottom plate 11), only a small amount of the liquid toner 6 may flow through the end face of the front section 12 and almost of the liquid toner may flow through the end face of the rear section 13.

The operation of the apparatus shown in FIGS. 3 and 4 will be explained as to a difference from the apparatus shown in FIGS. 1 and 2. Almost all of the developing liquid toner 6 to be supplied through the liquid toner supply passage 8 to the developing chamber 14 will flow in the developing electrode 5 (toward the developing chamber rear section 13) and a small amount of the remainder of the liquid toner will flow in the direction of the developing electrode 4 (toward the developing chamber front section 12). The flow rate ratio of the liquid toner is determined substantially by the distance (space) between the developing electrodes 4 and 5 and the electrophotographic latent image surface and an angle of the step 8'. In the case where the distance between the developing electrode 4 and the latent image surface is set equal to that between the developing electrode 5 and the latent image surface, there would be caused the serious problems as mentioned above. According to the apparatus shown in FIGS. 3 and 4, such problems may be well overcome as in the apparatus shown in FIGS. 1 and 2.

Figure 4:
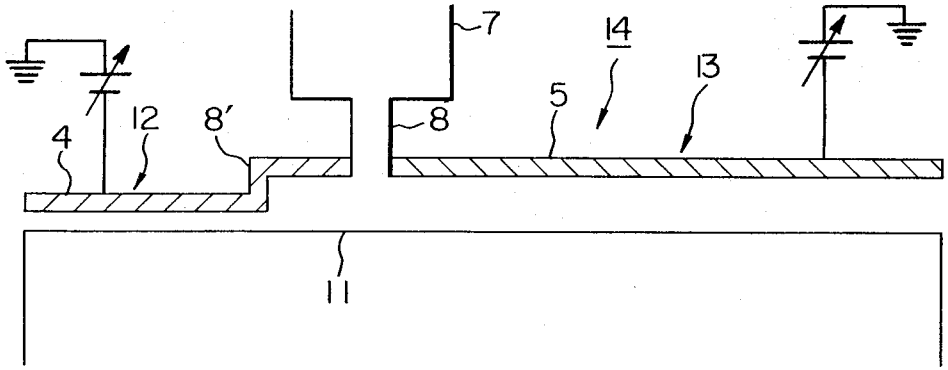
Figure 3:
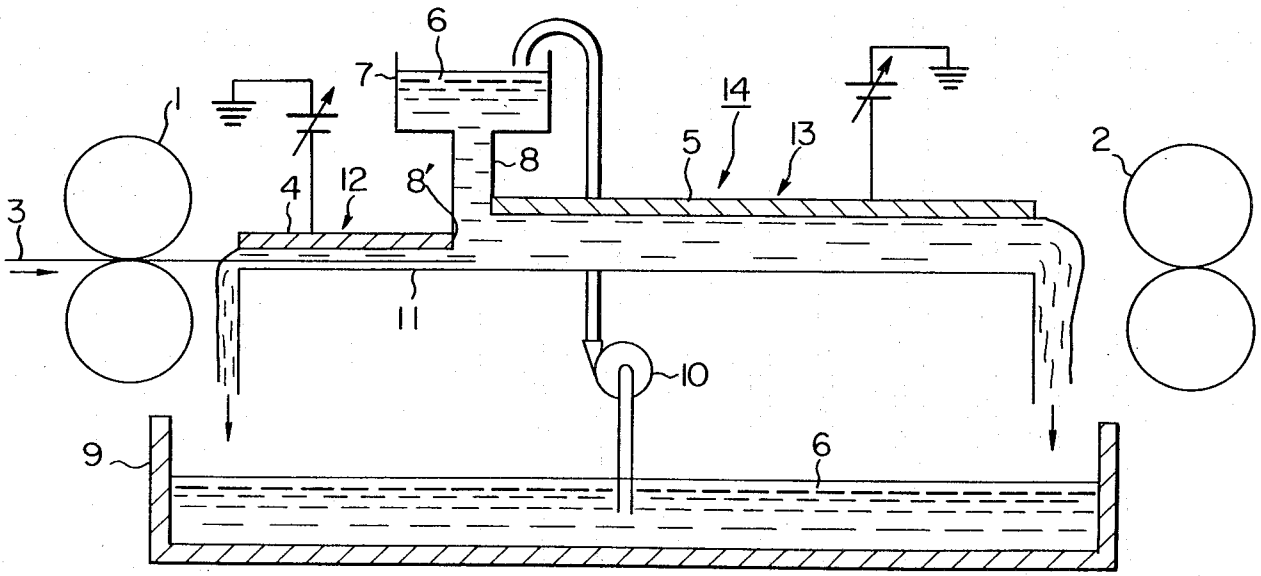

In the apparatus shown in FIGS. 3 and 4, the distance between the electrodes and the latent image surface may be gradually increased from the developing chamber front section 12 through the liquid toner supply passage 8 to the developing chamber rear section 13 as in the apparatus shown in FIGS. 1 and 2.

In FIGS. 3 and 4, the liquid toner supply passage 8 is provided in the perpendicular position. However, the arrangement of the supply passage is not limited thereto and an angle of the supply passage may be changed as desired. The wall at the step 8' formed at the boundary between the front section electrode 4 and the rear section electrode 5 may be slanted as desired.

Figure 5:
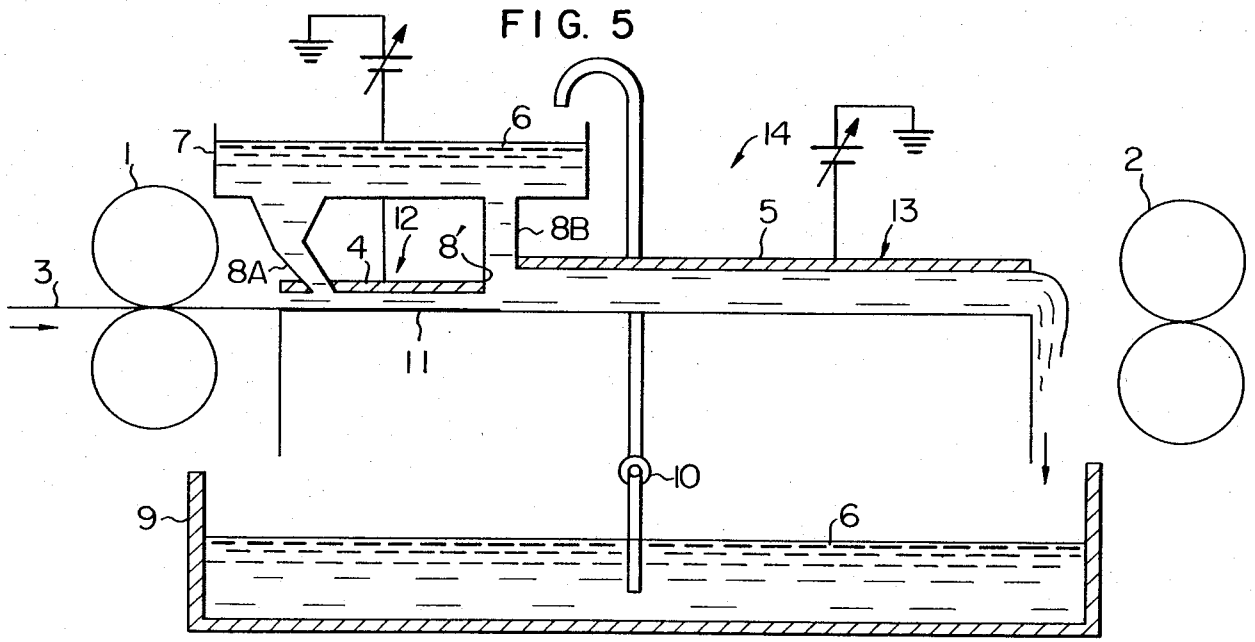
Figure 6:
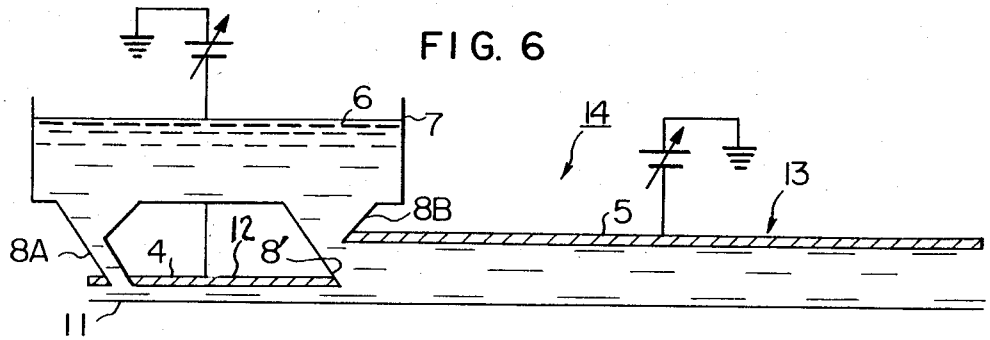

Subsequently, still other embodiments of the present invention will be explained with reference to FIGS. 5 and 6. The apparatus shown in FIGS. 5 and 6 is different from the apparatus shown in FIGS. 3 and 4 in the number of the liquid toner supply passages, the mounting position thereof and the shape thereof. Other structural components of the apparatus shown in FIGS. 5 and 6 are the same as those of the apparatus shown in FIGS. 3 and 4. Therefore, the explanations for the like components have been omitted. In the apparatus shown in FIGS. 5 and 6, the supply passage 8B is provided between the front section 12 and the rear section 13 of the developing chamber 14 and at the same time, another liquid toner supply passage 8A is provided in the developing chamber front section 12 so that it is slanted to make the liquid toner flow in the direction of the rear section 13. Furthermore, in the embodiment shown in FIG. 6, the supply passage 8B is tapered toward the developing chamber 14 and at the same time, the wall at the step 8' is slanted toward the rear section 13.

In the apparatus shown in FIGS. 5 and 6, the liquid toner supply passage 8A is also provided in the front section 12 of the developing chamber. However, the supply passage 8A is slanted toward the rear section 13 so that almost of the liquid toner to be supplied to the developing chamber 14 will flow through the open end face on the rear section 13 side. The supply passage 8B as shown in FIG. 6 is available.

The liquid toner 6 is supplied through the liquid toner supply passages 8A and 8B to the developing chamber 14. The supply passage 8A is slanted at an angle of about 20° to 60° so that the liquid toner is made to flow toward the developing chamber rear section 13. Some counterflow thereof to some extent is negligible. Diameters of the supply passages 8A and 8B are determined according to the amount and the rate of the liquid toner to be required. It is desirable that the flow rate in the developing chamber front section 12 be equal to that in the rear section 13. In the case where the supply passage 8A is not provided, and in addition, in the case where the distance between the developing electrode 4 and the latent image surface is equal to that between the developing electrode 5 and the latent image surface, the above described serious problems would be caused. However, according to the apparatus of the invention, such problems may be solved as in the embodiment shown in FIGS. 1 and 2.

The angles of the supply passage 8B and the wall of the step 8′ shown in FIGS. 5 and 6 are not limited to a right angle but may be slanted toward the direction of the liquid flow. Also, the liquid toner bath 7 may be divided for the supply passages 8A and 8B, individually. Furthermore, it is possible to provide the supply passage 8A as a branch of the supply passage 8B, extending from the midway of the supply passage 8B. Furthermore, two or more supply passages 8A and 8B, respectively, are available.

Figure 7:
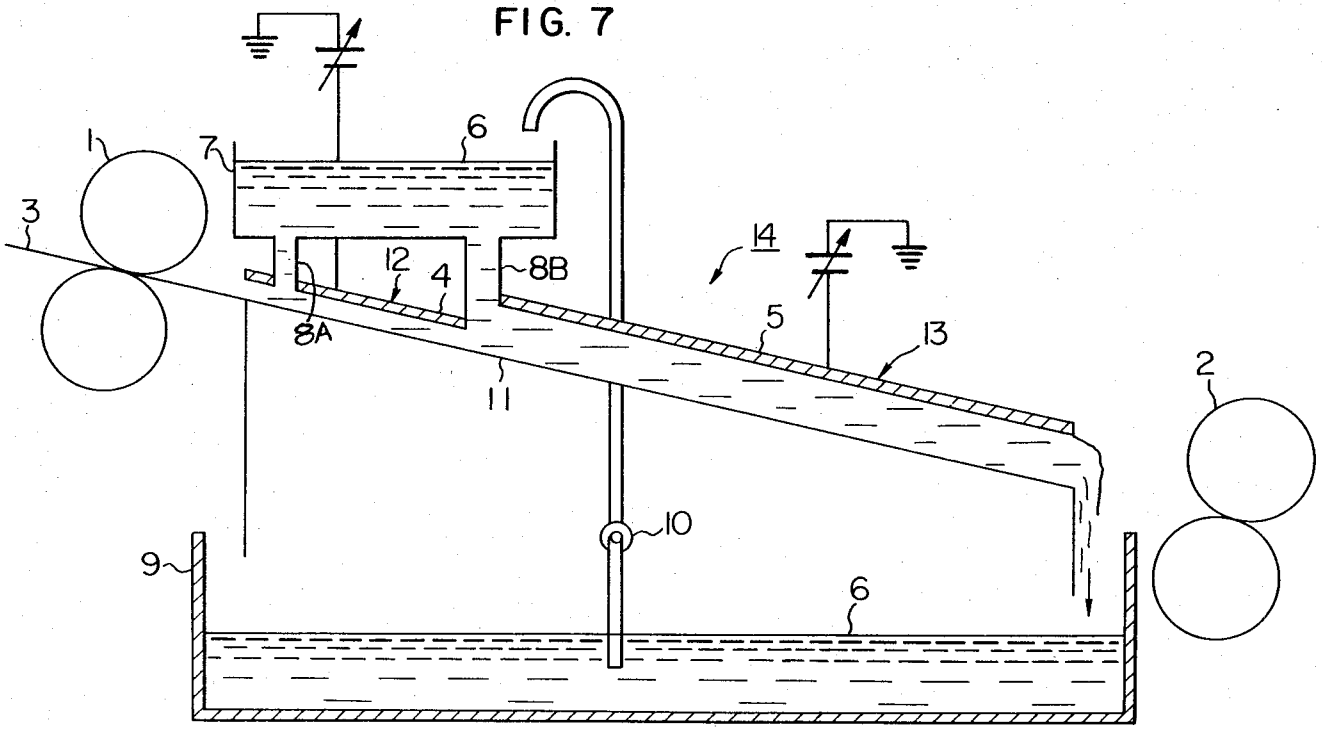
Figure 8:
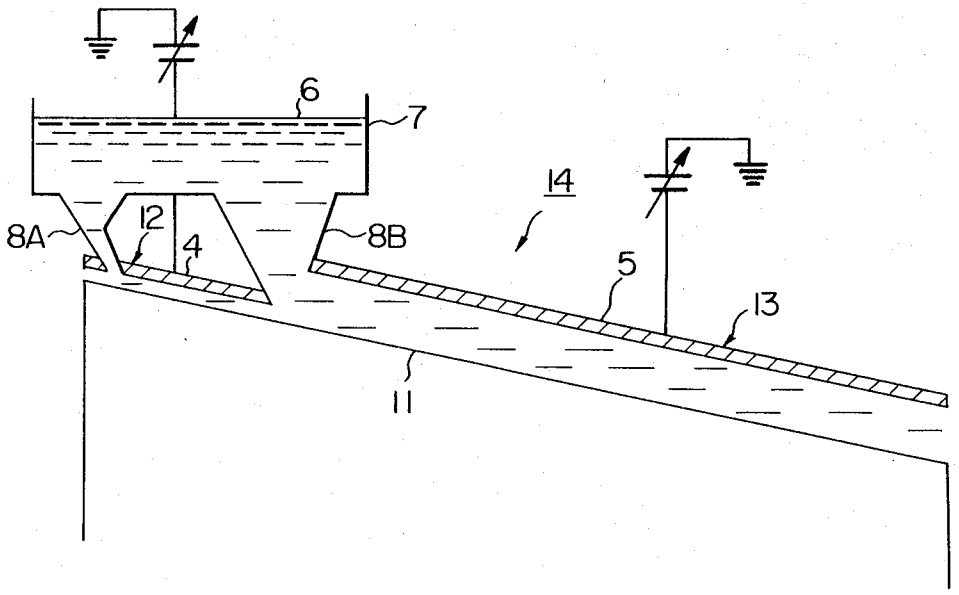

The other embodiments of the invention will now be explained with reference to FIGS. 7 and 8. The apparatus of this embodiment is substantially the same as that shown in FIGS. 1 and 2 except that these apparatuses are different from each other in the number, the mounting positions and the shapes of the liquid toner supply passages and in the slant angle of the developing chamber. Therefore, the explanations for the same components have been omitted.

In the apparatus, the supply passage 8B is provided between the front section 12 and the rear section 13 of the developing chamber 14 and at the same time, another supply passage 8A is provided in the front section 12 of the developing chamber. Furthermore, in the apparatus as shown in FIG. 8, the supply passages 8A and 8B are tapered toward the developing chamber 14 to become gradually thinner and the supply passage 8A is slanted toward the downstream direction side.

In the apparatus, it is preferable that the slant angle of the bottom plate, i.e., the developing chamber 14 be about 15° to 45°. The liquid toner 6 supplied into the developing chamber 14 is rendered to flow toward the lower side of the developing chamber rear section 13 at a flow rate in accordance with the slant angle. In compliance with the capacity of the photoconductive plate 3, a rapid development may be carried out for a short period of time. The above described defects which are liable to be caused due to the rapid development may be eliminated in the apparatus according to the invention. The diameters of the supply passages 8A and 8B are determined according to the amount and the flow rate of the liquid toner 6. The supply passage 8A is provided in the front section 12 as near to the upstream open end face as possible. In the case where over the total length of the developing chamber 14, the distance between the developing electrodes and the electrostatic latent image surface is kept constant (including the case where the supply passage 8B is not provided), the flow rate would be increased in comparison with the horizontal developing chamber 14, resulting in the above described serious defects. However, according to the apparatus shown in FIGS. 7 and 8, also, these defects may be eliminated.

In the apparatus, the distance between the electrodes and the latent image surface may be increased from the developing chamber front section 12 to the rear section 13. Also, the developing chamber may be separated for the supply passages 8A and 8B, respectively. Furthermore, it is possible to provide the supply passage 8A as a branch of the supply passage 8B, extending from the midway of the supply passage 8B. Also, two or more supply passages 8A and 8B, respectively, are available.

Since the apparatus according to the present invention is constructed and operated as has been described above, it is possible to reproduce a fine image clearly with an excellent resist property to eliminate photographic fog, halo, drags edge effect and the like. In addition, the pair of supply rollers would not be contaminated. Also, it is testified by experiments that the apparatus according to the present invention shows more excellent results in comparison with the developing apparatus in which the distance between the developing electrodes and the latent image surface is kept constant in the front and rear sections of the developing chamber.

We claim:

1. A liquid developing apparatus for electrophotography in which an electrostatic latent image surface of a photoconductive material is placed opposite developing electrodes and, at the same time, is transferred through a liquid toner, said apparatus comprising a developing chamber including means defining a transfer path for the photoconductive material, said means defining said path including a bottom plate having an upstream and a downstream side with respect to a direction of flow of the liquid toner, said path further including developing electrodes which face said bottom plate at predetermined intervals and including top plates and side plates wherein said developing chamber is divided into a front section and a rear section with respect to the photoconductive material path, said path having a width between the developing electrode in the front section of said chamber and the electrostatic latent image surface of said photoconductive material, said width being smaller than the width between the developing electrode in the rear section of said developing chamber and the electrostatic latent image surface of said material, said path having opposite end faces on the upstream and downstream sides thereof which are open and at least one supply passage being provided for the liquid toner, said supply passage being located between the front and rear sections of said developing chamber.

2. A developing apparatus as claimed in claim 1, wherein said developing chamber is slanted at an angle and said slant angle of said developing chamber is set in a range from about 15° to 45°.

3. The developing apparatus as claimed in claim 1 wherein said developing chamber is situated substantially in a horizontal position.

4. The developing apparatus as claimed in claim 1 wherein a supply passage for the liquid toner is also provided at the front section of said developing chamber.

5. The developing apparatus as claimed in claims 1 or 4 wherein said bottom plate is slanted at an angle with respect to the horizontal so that the developing liquid toner supplied from said supply passage will flow toward the front section, located at a higher level, of the developing chamber.

6. A developing apparatus as claimed in claim 5, wherein the slant angle of said developing chamber is set at an angle of 30° or less, more preferably, 20° or less.

7. A liquid developing apparatus for electrophotography in which an electrostatic latent image surface of a photoconductive material is placed opposite developing electrodes and, at the same time, is transferred through a liquid toner, said apparatus comprising a developing chamber including means defining a transfer path for the photoconductive material, said means defining said path including a bottom plate having an upstream and a downstream side with respect to a direction of flow of the liquid toner, said path further including developing electrodes which face said bottom plate at predetermined intervals and including two plates and side plates wherein said developing chamber is divided into a front section and a rear section with respect to the photoconductive material path, said path having a width between the developing electrode in the front section of said chamber and the electrostatic latent image surface of said photoconductive material, said width being smaller than the width between the developing electrode in the rear section of said developing chamber and the electrostatic latent image surface of said material, said path having opposite end faces on the upstream and downstream sides thereof which are open and at least one supply passage being provided for the liquid toner, said supply passage leading to the rear section of said developing chamber with said supply passage being located in proximity to the front section.

8. A developing apparatus as claimed in claims 4 or 7, wherein a length of said front section of said developing chamber is shorter than that of said rear section of said developing chamber in the photoconductive material transferring direction and a distance between the developing electrode in the rear section and the electrostatic latent image surface of said photoconductive material is 1.5 to 50 times longer than that between the developing electrode in the front section and the electrostatic latent image surface of said photoconductive material.

9. A developing apparatus as claimed in any of claims 4 or 7, wherein a liquid toner supply bath is provided above said developing chamber, the liquid toner is supplied from said supply bath to said developing chamber by the gravitational force, the liquid toner discharged from said developing chamber is collected into a liquid toner reservoir, and the collected developing liquid toner is recirculated to said supply bath by a pump.

10. The developing apparatus as claimed in claims 4 or 7 wherein said developing chamber is placed substantially in a horizontal position.

* * * * *